United States Patent [19]

Kelly

[11] Patent Number: 4,525,168

[45] Date of Patent: Jun. 25, 1985

[54] METHOD OF TREATING POLYARAMID FIBER

[75] Inventor: David R. Kelly, Dalton, Ga.

[73] Assignee: Professional Chemical & Color, Inc., Dalton, Ga.

[21] Appl. No.: 574,323

[22] Filed: Jan. 27, 1984

[51] Int. Cl.[3] ..... D06M 3/24

[52] U.S. Cl. ..... 8/130.1; 8/492; 8/542

[58] Field of Search ..... 8/130.1, 492, 542

[56] References Cited

U.S. PATENT DOCUMENTS

| | | | |
|---|---|---|---|
| 3,325,342 | 6/1967 | Bonner | 8/130.1 |
| 3,549,789 | 12/1970 | Haroldson | 8/130.1 |
| 3,564,630 | 2/1971 | Moussalli | 8/925 |
| 3,630,662 | 12/1971 | Brody et al. | 8/925 |
| 3,771,949 | 11/1973 | Hermes | 8/492 |
| 3,942,950 | 3/1976 | Powers et al. | 8/925 |

OTHER PUBLICATIONS

Bogle, M. *Textile Dyes, Finishes and Auxiliaries,* Garland Publ., Inc. N.Y. 1977, pp. 65–73.

*Primary Examiner*—Prince E. Willis
*Attorney, Agent, or Firm*—Alan H. Levine

[57] ABSTRACT

Polyaramid fiber is swollen, such as by exposing it to a solvent, and while swollen a substance, such as amine or substituted amine, capable of forming an ionic bond with an acid or anionic dye, is introduced into the fiber, after which the fiber is shrunk, such as by drying, to incorporate the substance into it. Thereafter, the fiber can be dyed or printed with an anionic dye. A solution of the solvent and substance may be prepared, and the fiber contacted with the solution.

11 Claims, No Drawings

METHOD OF TREATING POLYARAMID FIBER

This invention relates generally to dying and printing of polyaramid fiber, and products made therefrom, and more particularly to a pretreatment of the fiber prior to dying it or printing on it.

Polyaramid fibers, also known as high molecular weight aromatic polyaramide fibers are described in U.S. Pat. No. 4,198,494. These fibers are sold under the trademarks NOMEX and KEVLAR by E. I. duPont de Nemours and Co., and under the trademark CONEX by TeiJin Corp., a Japanese company. Fabrics made of these fibers are extremely strong and durable, and have excellent flame resistance characteristics. As a result of these properties, polyaramid fabrics have enjoyed a growing popularity in the protective clothing field and in other markets where protective fabrics find utility.

A serious problem presented by polyaramid fabrics, which has limited their acceptance in the marketplace, is that they are difficult to dye. An approach now used involves contacting the yarn or piece goods with a solvent, such as acetophenone, acetanilide, or methyl benzoate, to cause the fiber to swell. While in this condition, the fiber is contacted by a cationic dye, which is usually carried by the solvent. Due to the swollen condition of the fiber, the dye penetrates into it, this action being aided by the use of elevated temperature, e.g., 212° F. and higher. Polyaramid fibers dyed in this way by cationic dyes fade rapidly when exposed to sunlight and exhibit poor color fastness when washed, thereby making them unacceptable for many end uses.

To overcome this problem, manufacturers sometimes resort to solution dying, i.e., adding pigment to the molten polymer during manufacture of the fiber. However, solution dyed fibers are very expensive, which severly limits their commercial utility.

It is an object of the present invention to deal with these problems by providing a method whereby polyaramid fibers can be dyed and printed with anionic dyes, i.e., acid dyes, acid premetalized dyes, and direct dyes. Each of these types of dyes exhibit a greater degree color fastness upon exposure to light, when applied to polyaramid fibers, than do cationic dyes. In fact, certain members of these dye catagories are as much as 400% more color fast than are cationic dyes.

It is another object of the invention to provide a method of pretreating polyaramid fiber, prior to dying, to provide dye sites in the fiber capable of reacting with anionic dyes.

Additional objects and features of the invention will be apparent from the following description.

Polyaramid fiber shows very little affinity for anionic dyes even when swelled by a strongly polar solvent, such as acetophenone, at very high temperature, e.g., 260° F. Therefore, at present, while the fiber is swollen, a cationic dye is introduced into it. However, as pointed out above, polyaramid fabrics dyed with cationic dyes exhibit poor color fastness when exposed to sunlight and when washed.

According to the present invention, polyaramid fiber, or products made from it such as yarn or textile fabric, is caused to swell. While in the swollen condition, there is introduced into the fiber a substance capable of forming a strong chemical bond with an anionic dye. The fiber is then allowed to shrink back to its original condition and thereby incorporate the dye site substance into it. In this way, the fiber is provided with dye sites capable of bonding with anionic dyes, whereby the fiber can be dyed or printed on with an anionic dye.

While any material capable of forming a strong chemical bond with anionic dyes may be used as the dye site substance, certain amines and substituted amines have been found to perform very well. These amines may be aliphatic, having the following general structures:

$$H_2N-(CH_2)_x-NH_2$$

or $$R'N-(CH_2)_x-NR$$

or they may be aromatic, having the following general structure:

$$H_2N-Ar-NH_2$$

or $$R'N-Ar-NR$$

where R and R′ equal any aliphatic or aromatic substitutions, and x indicates the number of methyl groups.

Examples of aliphatic amines which have worked well in carrying out the present invention are hexamethylene diamine:

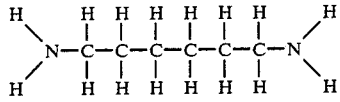

and hexamethylene tetramine:

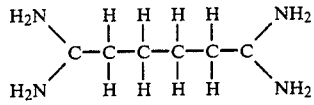

An example of an aromatic amine which has worked well is o-phenylene diamene:

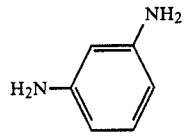

Swelling of the polyaramid fiber may be accomplished in any suitable manner, such as by contacting the fiber with a srongly polar solvent. It is convenient to swell the fiber and introduce the dye site substance into it at the same time by contacting the fiber with a solution of the dye site substance and the solvent.

Therefore, any solvent capable of swelling polyaramid fiber and dissolving the selected amine or other dye site substance can be used to conveniently carry out the invention. Solvents such as dimethyl formamide, dimethyl sulfoxide, and dimethyl acetamide have been used successfully.

The solution should contain from one to 50 parts of the dye site substance and from 99 to 50 parts of the solvent. It may be desirable to use a minor amount of a wetting agent. Polyaramid fiber, yarn, or fabric is immersed in the solution to allow the fiber to swell and the dye site substance to permeate into it. Swelling begins immediately upon immersion, as does permeation of the fiber by the dye site substance. Thus, any amount of time of immersion yields some results. However, it has not been found to be useful to extend immersion beyond about thirty minutes. The amount of dye site substance picked up by the fiber while in the solution depends upon the following factors:

(1) the concentration of the dye site substance in the solution;

(2) the length of time the fiber is exposed to the solution; and (3) the temperature of the solution.

The higher the concentration of dye site substance, the longer the time of exposure, and the higher the temperature, the more dye site substance will be picked up.

When the fiber is dried, it shrinks back to its original condition, except that the dye site substance becomes entrapped in the structure of the fiber and hence a permanent part of the fiber.

An example of a preferred pretreatment according to the invention is as follows:

A solution was prepared containing the following constituents:

89 parts of dimethyl sulfoxide (solvent)
10 parts of hexamethylene diamine (dye site substance)
1 part of ethylene oxide base (wetting agent)

A polyaramid fabric was advanced through the room temperature solution at the rate of eight yards per minute, so that each unit area of the fabric was immersed in the solution for about 15 to 20 seconds. The wet fabric was passed between nip rollers which applied two and one half tons of pressure to reduce the wet pickup of the fabric to 75%–80%, i.e., after passing through the nip rollers the moisture remaining in the fabric comprised about 75%–80% of the total weight of the moist fabric. The fabric was then dried to bone dryness at a temperature of 250° F.

Dimethyl sulfoxide and hexamethylene diamine are the preferred solvent and dye site substances, respectfully, because they are completely safe, easy to handle, and readily available commercially. The preferred concentration of 10% amine has been found to work well at room temperature, thus avoiding the need to heat the solution.

After a polyaramid product has been pretreated as described above, it can be successfully dyed by an anionic dye, i.e., an acid dye, an acid premetalyzed dye, or a selected direct dye. The dyeing procedure, whether it be stock dyeing of fibers, skein or packing dyeing of yarns, piece dyeing of fabrics, or printing on fabrics, may be carried out by conventional methods.

When polyaramid fiber containing an amine dye site substance is contacted by an anionic dye or print paste, the nitrogen groups of the amine take on a cationic charge. These amine groups are thus available to form a strong ionic bond with the acid or anionic dye in the dye bath. The reaction may be illustrated as follows:

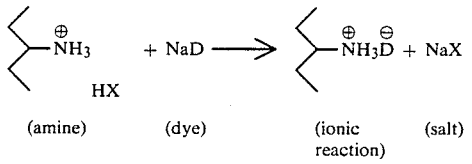

For the present purposes, an anionic dye is defined as a dye which contains one or more sulfonic acid groups, present as the acid or as the sodium or other salt or sulfonic acid. Examples of such dyes capable of reacting with polyaramic fibers treated according to the invention are the following:

acid dye: acid green 25, 61570, alizarine fast green G

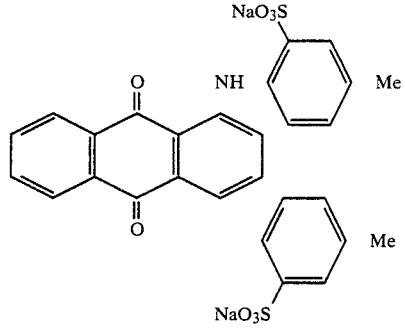

acid premetalized dye: C.I. acid violet 78, irgalan violet DC (C-G)

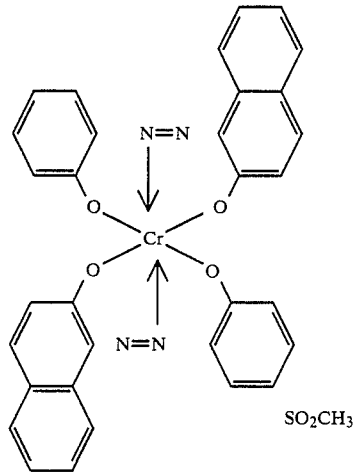

direct dye: C.I. direct yellow 59, primuline

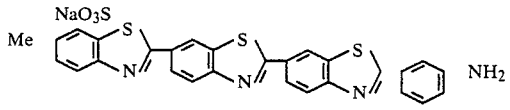

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A method of treating polyaramid fiber, comprising the steps of:

swelling the fiber, introducing into the swollen fiber a substance capable of forming an ionic bond with an anionic dye, and shrinking the fiber so as to incorporate said substance into the fiber.

2. A method as defined in claim 1 wherein the fiber is swelled by exposing it to a solvent.

3. A method as defined in claim 2 wherein the solvent is selected from the group consisting of dimethyl formamide, dimethyl sulfoxide, and dimethyl acetamide.

4. A method as defined in claim 1 wherein said substance is an amine or substituted amine.

5. A method as defined in claim 4 wherein said amine or substituted amine is an aliphatic compound having the general formula $H_2N—(CH_2)_x—NH_2$ or $R'N—(CH_2)_x—NR$, where R and R' are any aliphatic or aromatic substitutions, and x is the number of methyl groups.

6. A method as defined in claim 4 wherein said amine or substituted amine is an aromatic compound having the general formula $H_2N—Ar—NH_2$ or $R'N—Ar—NR$, where R and R' are any aliphatic or aromatic substitution.

7. A method as defined in claim 1 including exposing the fiber, after shrinking, to an anionic dye.

8. A method of treating polyaramid fiber, comprising the steps of:

exposing the fiber to a solvent which causes the fiber to swell, while the fiber is swollen, exposing it to an amine or substituted amine capable of forming an ionic bond with an anionic dye so that the amine permeates the fiber, and drying the fiber to incorporate the amine into it.

9. A method as defined in claim 8 including preparing a solution of the amine or substituted amine in the solvent, and exposing the fiber to the solvent and amine simultaneously by contacting the fiber with the solution.

10. A method as defined in claim 9 wherein the solution contains from 1 to 50 parts of the amine or substituted amine and from 99 to 50 parts of the solvent.

11. A method as defined in claim 9 wherein the solution contains 10% of the amine or substituted amine.

* * * * *